US005270011A

United States Patent [19]

Altherr

[11] Patent Number: 5,270,011

[45] Date of Patent: Dec. 14, 1993

[54] PLASTIC REACTION VESSEL FOR SMALL LIQUID VOLUMES

[76] Inventor: Ralph Altherr, Seeblickstrasse 16, 9113 Degersheim, Switzerland

[21] Appl. No.: 789,338

[22] Filed: Nov. 8, 1991

[30] Foreign Application Priority Data

Nov. 19, 1990 [CH] Switzerland ..... 3668/90

[51] Int. Cl.[5] ..... B01L 3/00

[52] U.S. Cl. ..... 422/102; 422/99; 215/216; 215/237; 220/324; 220/339; 292/246; 292/DIG. 38

[58] Field of Search ..... 422/102, 99; 435/296; 220/324, 339; 215/216, 237, 354, 344; 292/DIG. 38, 246

[56] References Cited

U.S. PATENT DOCUMENTS 3,999,678 12/1976 Ignell et al. ..... 220/339
4,664,273 5/1987 Simon ..... 215/216
4,665,596 5/1987 Green ..... 292/DIG. 38
4,713,219 12/1987 Gerken et al. ..... 422/102
4,787,526 11/1988 Pehr ..... 215/216
4,852,770 10/1989 Jessop et al. ..... 215/354
5,005,721 4/1991 Jordan ..... 422/102
5,031,784 7/1991 Wright ..... 215/216

FOREIGN PATENT DOCUMENTS 149797 of 0000 European Pat. Off. ..... 422/102
1275795 of 0000 Fed. Rep. of Germany .

*Primary Examiner*—Robert J. Warden
*Assistant Examiner*—Hien Tran

[57] ABSTRACT

A plastic reaction vessel for small liquid volumes is provided with a lid for closure of the opening of the vessel. The lid is held in the closed position by a securing device which comprises a flexible backing tab and a securing peg.

7 Claims, 2 Drawing Sheets

PLASTIC REACTION VESSEL FOR SMALL LIQUID VOLUMES

The invention concerns a plastic reaction vessel for small liquid volumes. Reaction vessels such as these, which generally replace test tubes, are, for example, already known from the German patent specification 1 275 795 of the European patent specification 149 797. A lid is intended with these types of reaction vessels which is mostly moulded onto the reaction vessel in one piece. For example, as is known from column 3, line 25 of DE-AS 1275 795, a profile, for example an annular recess on the protrusion of the lid, and a bead type annular profile on the vessel opening, are intended for positive connection between the lid and the reaction vessel, so that the lid engages positively when being closed. Broadly expressed, this type of construction concerns a snap closure. EP-PS 149 797 also concerns a snap closure, whereby, however, a hook type projection on the lid rim is intended as the snap component, which snaps over an engagement edge.

These types of snap closures are, in their function, dependent on the elasticity of the plastic used, and thus not least of all on the effect of temperature and ageing. In practice, it has been demonstrated that for these reasons snap closures of this type do not remain reliably shut during large increases of pressure within the reaction vessel, for example during warming, agitation or when accidentally dropped.

Particular problems would still arise with snap closures, if elastic sealing elements would be provided which are tensioned by the closing pressure of the snap closure. Reaction vessels with sealing elements are thus, as a rule, closed by extravagant screw threads or additional locking clips.

In practice it has also been demonstrated that, mainly with hook snap closures, operating convenience is adversely affected. The high initial tension required by the hook closure hinders opening by the operator, and in particular opening using only one hand.

It is the purpose of the invention to avoid these known disadvantages, and therefore to create in particular a plastic reaction vessel which can be reliably secured in a closed condition, which is, in spite of this, easy to open and at the same time can be simply and economically manufactured.

According to the invention, this is achieved primarily through a reaction vessel according to the characteristics of claim 1. In place of the known snap closure on the reaction vessel, according to the invention a securing device is intended with which the lid and the vessel are positively connected. Obviously, the positive fit ensures a firm connection of the lid and the vessel by means of the securing device. If the securing device possesses, for example, a flexible clip with at least one opening, this can be manufactured in one piece with the plastic of the lid and/or the vessel without problems, mainly through moulding. The same applies to the securing peg over which the flexible clip with its opening is positioned and thus can be secured. Generally, reaction vessel, lid and securing device can be arranged in such a way that they can be manufactured as one piece, in one working sequence, by means of injection moulding, which will ensure economical fabrication.

The invention can be realised and handled especially simply if the flexible clip is attached to the lid and the peg is attached to the vessel. Mainly from an injection moulding point of view, such simple solutions such as these can be achieved with rapid injection moulding cycles. In so far as the lid is connected to the vessel on one side by a flexible link, it can be sufficient to provide a flexible clip for securing the lid in the area approximately radially opposite the connecting link. Obviously, with that, the lid will be held firmly on the opening of the reaction vessel on one side by the flexible clip of the securing device and on the other side by the flexible or connecting link. In order to reliably avoid disengagement of the flexible clip from the securing peg, it is advantageous if the securing peg possesses at least one engagement edge on its side which lies opposite to the lid opening. In this way, the flexible clip can positively locate behind the engagement edge, which will prevent accidental disengagement of the flexible clip. In order to optimise engagement of the flexible clip onto the securing peg, it can be advantageous to provided a spring element, with initial tension in the direction of opening, between the lid and the vessel. The spring element can be provided on the lid or the vessel, or formed as a separate component.

It is also advantageous if a protrusion is provided which neighbours the flexible clip. The protrusion can, on the one hand, serve as a protection for the flexible clip to avoid accidental opening, and on the other hand the protrusion can be formed as a rigid press lug provided on the lid, in order to facilitate opening of the lid and also mainly to make possible one handed operation.

Naturally, the securing device anticipated according to the invention can additionally be intended for the snap closure devices already known, for example DE-PS 1275 795. This makes possible closure of the securing device solely according to requirements, for example prior to placement within a centrifuge or before heat treatment, but enables the device to be ignored, however, during transitory opening and closing.

The invention can be realised for particularly convenient use if the lid is provided with two press lugs at a distance from one another which run approximately in the plane of the lid and if the flexible clip is arranged between the press lugs.

Particularly reliable sealing of the reaction vessel can be achieved if, between the lid and the vessel, an elastic seal is provided which is held under initial tension by the securing device. The initial tension caused by the securing device leads to compression of the plastic seal, whereby, for example, the escape of gases, with raised inner pressure of the reaction vessel, can be prevented.

From a constructional point of view, such a seal can be realised simply if an annular seal is provided. The seal can take the form of a separate sealing element or an elastic sealing component moulded onto the lid and/or the vessel, for example, as a sealing lip.

A particularly good protection for the opening of the reaction vessel, and a guard against accidental contact of contaminated parts of the lid area, can be achieved, according to the invention, if a lid is provided which surrounds the vessel rim like a cap and if a seal is arranged between the cap base and the vessel rim.

BRIEF DESCRIPTION OF THE DRAWINGS

The invention is more closely described in the following, in different embodiments. Namely.

Figure 1:
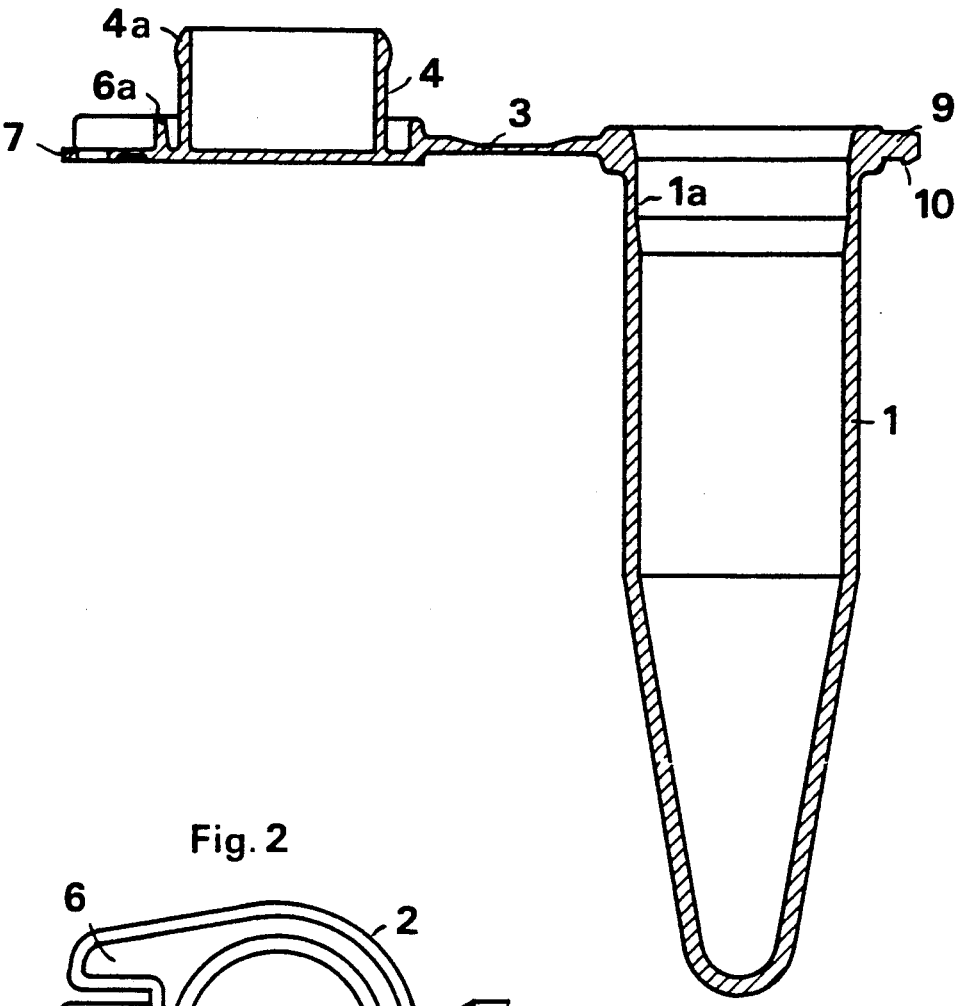
FIG. 1: a schematic representation of a reaction vessel in section.
Figure 2:
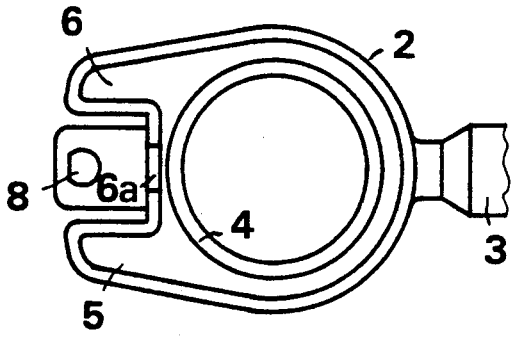
FIG. 2: a plan view of the lid of the reaction vessel according to FIG. 1, FIG. 3: a view from beneath of the reaction vessel according to FIG. 1, FIG. 4: the reaction vessel according to FIGS. 1 to 3 in a closed condition.
Figure 3:
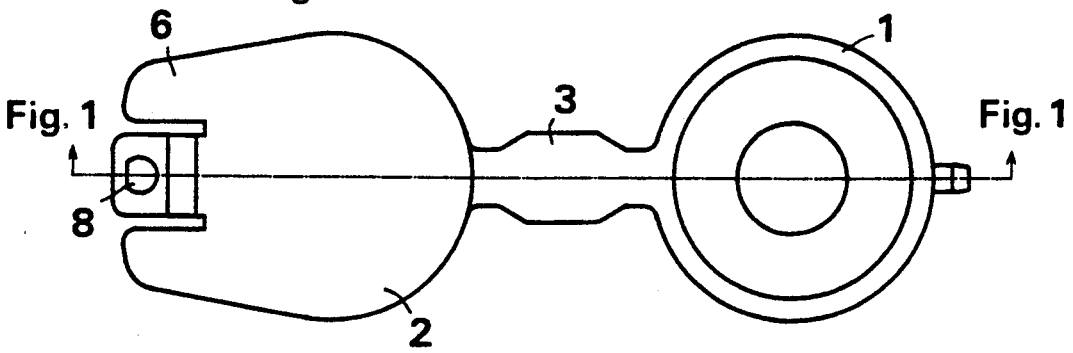

According to FIGS. 1 to 4, a reaction vessel 1 manufactured by the injection moulding method is formed in one piece with a lid 2. Reaction vessel 1 and lid 2 are, with that, connected by a link 3 in such a way that the link 3 on one hand holds the lid 2, without possibility of loss, on the reaction vessel 1 and, according to FIG. 4, on the other hand the lid 2 is held in position by the link 3, as with a hinge, in a closed condition. The lid 2 possesses a cylindrical sealing part 4 which is provided on its end with a bead type sealing element 4*a*. The sealing element 4*a* snaps into an equivalent annular recess 1*a* on the inner wall of the reaction vessel 1 when closing the lid. In this respect a snap closure is concerned, whereby the sealing element 4*a* assumes the dual function of sealing and snapping-in.

Two lift tabs or protrusions 5, 6 are provided on the lid 2 which assume the function of press lugs. In order to open the closed reaction vessel 1, the user can simply press with his thumb against the protrusion 5 or 6 and thus slide the sealing part 4 upwards out of the vessel 1. A flexible locking tab or clip 7 with an opening 8 is arranged between both the protrusions 5, 6. In an unbent condition, the flexible clip 7 is in the same plane as the two protrusions 5 and 6.

Figure 4:
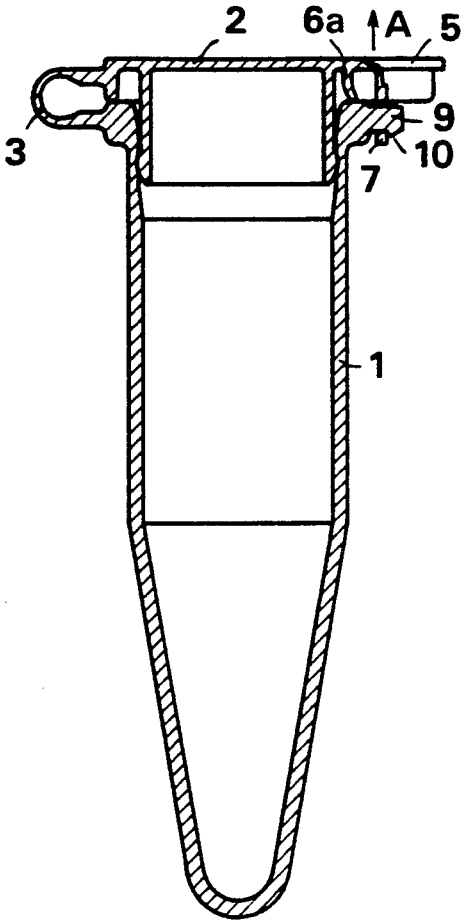

After closure of the reaction vessel 1 by the lid 2, the flexible clip 7, according to FIG. 4, can be bent downwards in such a way that the opening 8 snaps over a peg 9 provided on the vessel 1. The securing peg 9 possesses an engagement edge 10 on its under side which prevents the flexible clip 7 from freeing itself from the securing peg 9. A lip type spring element 6*a*, which is pressed together when closing the lid 2, is provided on the lid 2. With that, a force arises in the direction of arrow A (FIG. 4) which pulls the flexible clip 7 behind the engagement edge 10.

To open, the flexible clip 7 can simply be slipped over the securing peg 9 and the lid 2 can after that be lifted up level with the protrusions 5 and 6. This can also be carried out with one hand.

In the versions according to FIGS. 1 to 4, the lid 2 is secured in its closed condition by the link 3, with its function as a hinge, and the flexible clip 7. Naturally it is also conceivable to provide not only one, but several flexible clips if a container is to be secured at numerous points. It is also conceivable to provide a flexible clip 7 in place of the link 3.

The protrusions 5 and 6 protect the flexible clip 7 from accidental opening with particular advantage. Alternatively, it would naturally also be conceivable to provided only one protrusion or a saucer shaped protruding rim, by means of which the lid 2 can be lifted up and opened. Although the arrangement of the flexible clip 7 on the lid 2 makes possible especially simple manufacture and handling, versions are also conceivable with which the flexible clip 7 is fixed to the vessel 1, and the securing peg 9 is fixed to the lid.

Figure 5:
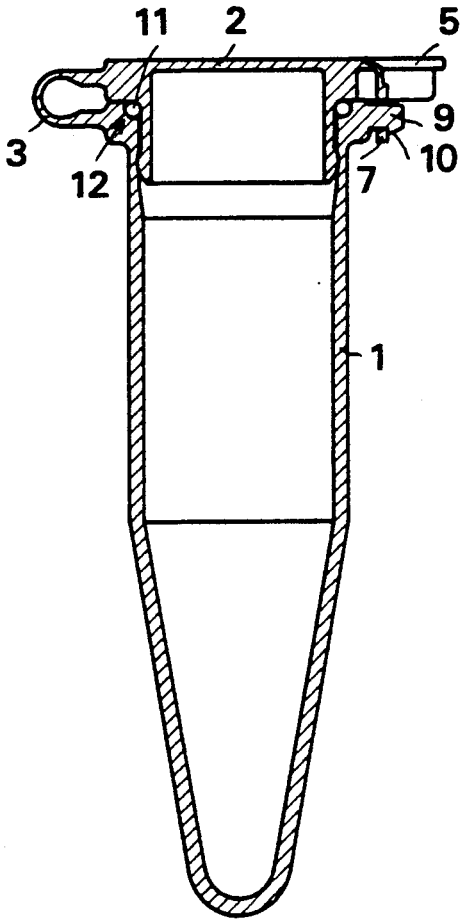
FIG. 5: a schematic sectional representation of a reaction vessel with elastic sealing element.

FIG. 5 shows an embodiment of the invention with which an elastic sealing ring 11 is arranged between the lid 2 and the rim 12 of the vessel 1. Especially effective sealing of the vessel 1 is caused through the elastic sealing ring 11. When closing, the lid 2 is first of all pressed so firmly down onto the vessel 1 that the flexible clip 7 can be pushed over the engagement edge 10 of the securing peg 9. Subsequently, the sealing ring 11 can once again be slightly relaxed, whereby the flexible clip 7 is pulled firmly under the engagement edge 10.

Figure 6:
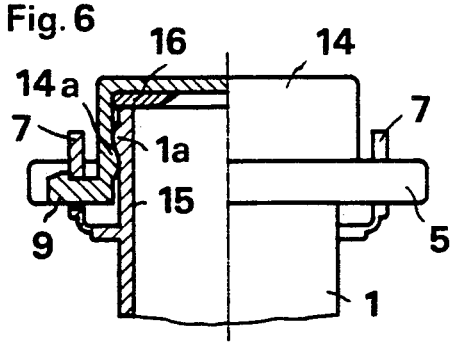
FIG. 6: a partial section through a modified reaction vessel with lid along the section according to the line A in FIG. 7, and FIG. 7: a plan view of the lid according to FIG. 6.
Figure 7:
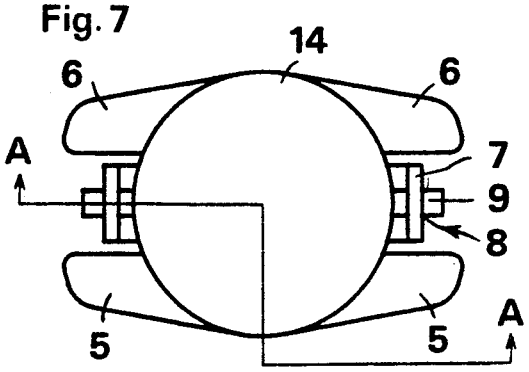

With the embodiment according to FIGS. 6 and 7, a lid 14 is portrayed which surrounds the opening of the reaction vessel 1 from the outside. Similar to the embodiment according to FIGS. 1 to 4, a bead type sealing element 14*a* is provided on the lid 14 which surrounds the vessel opening 15 to seal it and snaps over a complementary bead 1*a*. Additionally, an elastic annular seal 16, which seals the face of the vessel opening 15, is intended on the inside of the cap base 14. Two flexible clips 7 are provided on the vessel 1 which can be bent upwards in such a way that, with openings 8, they can be slipped over the securing pegs 9 which are fixed to the lid 14, similar to the embodiments according to FIGS. 1 to 5. The securing pegs 9 are bordered by protrusions 5, 6 on both sides, whereby the flexible clips are protected.

I claim:

1. In a reaction vessel made of plastic for containing a small volume of liquid, and including a hollow vessel body having an outside surface, an inside surface and an edge portion which defines an opening, a closure attached to the hollow vessel body comprising a base wall, a cylindrical sealing part which extends through said opening into said hollow vessel body and is removable therefrom, said sealing part coming into sealing engagement with said inside surface, and a flexible link having opposite ends that are respectively integral with said vessel body and said closure, said link permitting said closure to be removed from said vessel body, the improvement comprising:

said closure having at least one lift tab and at least one flexible locking tab, said lift tab and said flexible locking tab normally extending approximately coplanar with and radially outward from the base wall, said vessel having a securing peg extending radially outwardly from the outside surface of said vessel body adjacent to said edge portion, said flexible locking tab having means defining a hole therethrough, and being bendable from its normally outwardly position to a securing position, in which said hole receives said peg, whereby the vessel may be closed with one hand by engaging said lift tab, pivoting the closure about said link towards said opening and pressing the sealing part into said vessel body and by then bending the flexible locking tab towards the vessel until said hole receives said peg.

2. The reaction vessel of claim 1, comprising two lift tabs which are arranged substantially coplanar and at a distance from one another on either side of said flexible locking tab.

3. The reaction vessel of claim 1, further comprising an elastic seal between the closure and the vessel, said seal being held in compression by the securing device.

4. The reaction vessel of claim 1, further comprising an annular elastic seal surrounding the sealing part.

5. The reaction vessel of claim 1, wherein the closure has a peripheral flange surrounding the opening, and further comprising a seal disposed between the closure and said edge portion.

6. The reaction vessel of claim 5, further comprising a spring element extending between the closure and the vessel, biasing the closure toward an open position.

7. The reaction vessel of claim 1, further comprising a spring element between the closure and the vessel, biasing the closure toward an open position.

* * * * *